United States Patent [19]

Nielsen

[11] Patent Number: 4,706,401

[45] Date of Patent: Nov. 17, 1987

[54] TRIGGER MECHANISM FOR A WEAPON

[76] Inventor: Bent A. Nielsen, Tyrolsgade 1, 2300 Copenhagen, Denmark

[21] Appl. No.: 870,292

[22] PCT Filed: Mar. 10, 1982

[86] PCT No.: PCT/DK82/00020

§ 371 Date: Nov. 10, 1982

§ 102(e) Date: Nov. 10, 1982

[87] PCT Pub. No.: WO82/03120

PCT Pub. Date: Sep. 16, 1982

Related U.S. Application Data

[63] Continuation-in-part of Ser. No. 763,888, Aug. 8, 1985, abandoned, and a continuation of Ser. No. 444,510, Nov. 10, 1982, abandoned.

[51] Int. Cl.[4] ..... F41D 11/02; F41C 19/00; F41C 17/00

[52] U.S. Cl. ..... 42/69.03; 42/70.01

[58] Field of Search ..... 42/69.01, 69.02, 69.03, 42/70.01

[56] References Cited

U.S. PATENT DOCUMENTS 2,464,427 3/1949 Wilson .
2,846,925 8/1958 Norman ..... 42/69 B
2,959,107 11/1960 Srurtevant .
3,060,810 10/1962 Hillberg .
3,128,570 4/1964 Browning .
3,889,412 6/1975 Filecci .
3,950,876 4/1976 Wild et al. .

FOREIGN PATENT DOCUMENTS 1157247 7/1969 United Kingdom .
1290330 9/1972 United Kingdom .

OTHER PUBLICATIONS

EP, A2, 0025 518, (Kepplinger), 3/25/81.
CH, A5, 626,987, (Beretta), 12/15/81.
CH, A4, 620,763, (Walther), 12/15/80.
SE, B, 368,081, 2/25/72.

*Primary Examiner*—Deborah L. Kyle
*Assistant Examiner*—Ted L. Parr
*Attorney, Agent, or Firm*—Ladas & Parry

[57] ABSTRACT

By providing the trigger mechanism in a pistol with a lever (8) which is mounted at its rearmost end on an axle (10), and by providing said axle (10) with a notch which can hold a superjacent hammer retainer (13) having a projection (20), it is possible to release the hammer retainer (13) and thus the hammer (11) by applying a very weak force to the opposite end of the lever (8).

The connection between the actual trigger (2) and the gripper (5) is effected through a rotatable disconnector (1) with an upwardly extenidng stud. The slide (17) is provided with a recess (18) which, when the slide (17) is in its forward position, lies opposite the stud. It is thus possible to ensure that the trigger mechanism cannot function unless the slide is in its forward position and thereby has the stud lying opposite the recess.

4 Claims, 10 Drawing Figures

TRIGGER MECHANISM FOR A WEAPON

Figure 1:
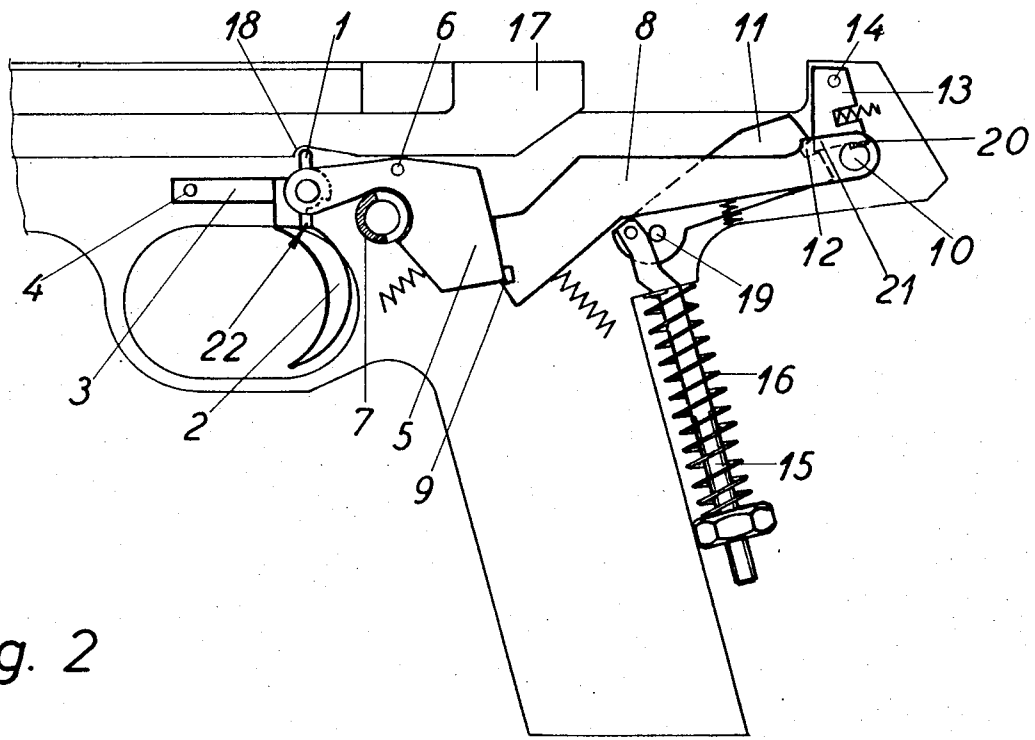

This is a continuation-in-part of co-pending application Ser. No. 763,888 filed on Aug. 8, 1985, which is a continuation of Ser. No. 444,510 filed Nov. 10, 1982 which is abandoned.

This invention relates to a trigger mechanism for a pistol with a trigger, which when activated releases a spring-loaded hammer, and also to a combined locking and safety device for a weapon with a trigger which acts upon a disconnector which, via a gripper, a lever and a hammer retainer, releases the hammer.

Hitherto known trigger mechanisms demand a relatively strong force and long travel of the moving parts in order to be able to function satisfactorily and safely. This is due to the high degree of friction which exists between the strongly spring-loaded parts which must be mutually displaced in order for the release and thus the disengagement of the hammer to take be effected. This gives rise to difficulty in achieving the desired and precise amount of pull required on the trigger, and also makes it difficult to bring about sufficiently short travel of the moving locking parts. Thus, since the trigger pull is of considerable importance to the accuracy of the pistol, the marksmanship capable of being achieved is affected.

Moreover, hitherto known safety devices for weapons have been limited to arrangements which prevent movement of the trigger mechanisms. They do not provide for locking of the parts of the weapon against separation, and they do not constitute a lock which provides the security that a part is required in order to unlock and lock the weapon after the insertion of the part in the weapon.

The object of the present invention is to overcome the deficiencies of the hitherto known trigger mechanisms, and this object is achieved when the mechanism includes a trigger-actuated lever which is suspended at the rear on the upper part of the pistol, and is fixedly connected to a pivotal axle having a projection which can engage with a projection on a gripper, said gripper being pivotally mounted on an overlying axle and having a projection which can engage with a recess in the exterior of the hammer. This construction constitutes a lever system with a high exchange ratio between the trigger and the release part for the hammer. This means that only a small load need be applied to the one end of the lever to turn the other end at the axle and thus release the hammer. Consequently, the pressure required on the trigger is considerably relieved, so that only a minimal movement of the trigger and a minimal force is required to release the hammer.

As presented in claim 2, by releasing the front end of the lever by means of a pivotally mounted gripper actuated by the trigger, it is possible to employ the mechanism as a dry-run training unit, in that the lever can be cocked and released by the trigger without the hammer being cocked.

As presented in claim 3, by providing the gripper with a pivotal coupling, disconnector, the possibility is created of ensuring that the trigger is capable of functioning when the slide is forward, without any friction or resistance arising in the trigger mechanism.

Moreover, as presented in claim 4, it is expedient for the disconnector to have an outwardly extending stud which engages with a recess in the slide, thus ensuring that coupling can take place in this and only in this position.

Figure 2:
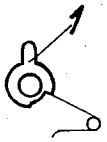
Figure 3:
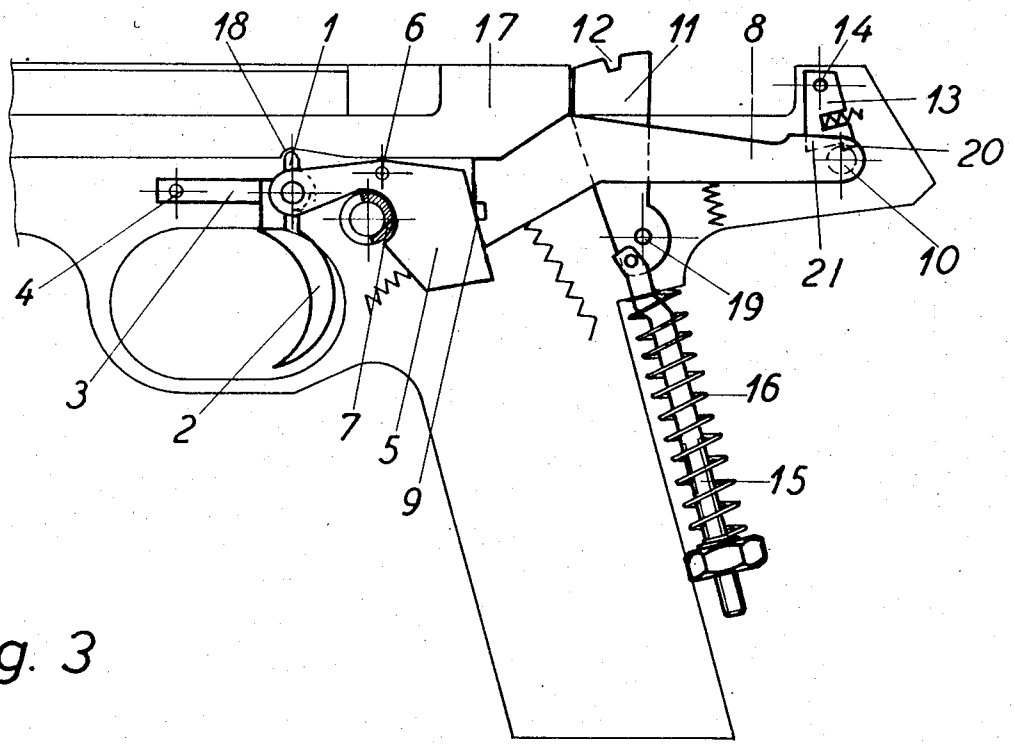
Figure 4:
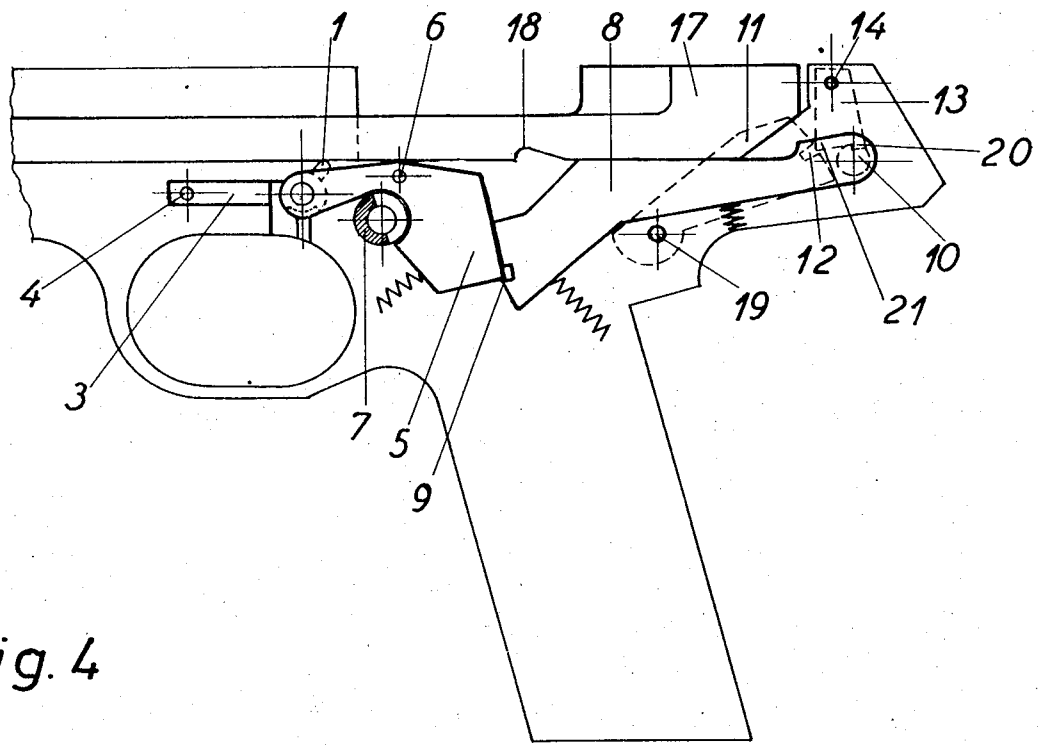
Figure 5:
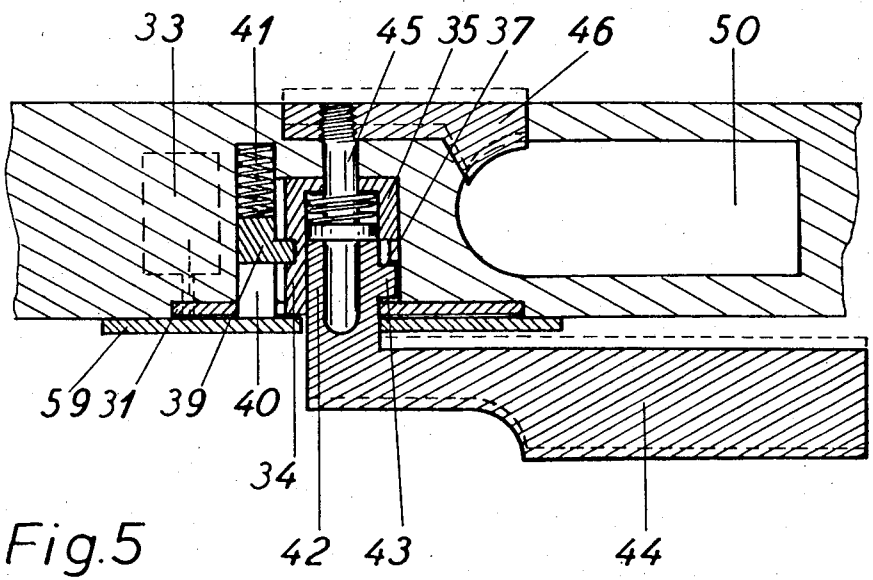
Figure 6:
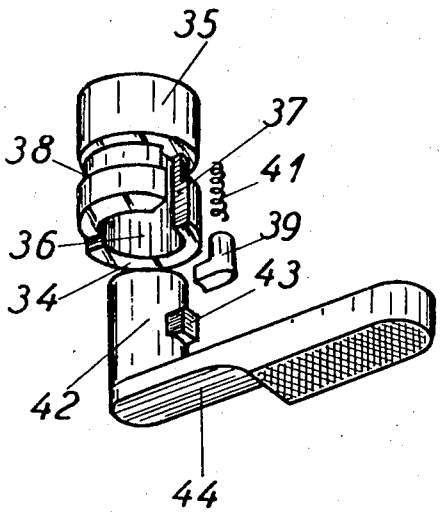
Figure 7:
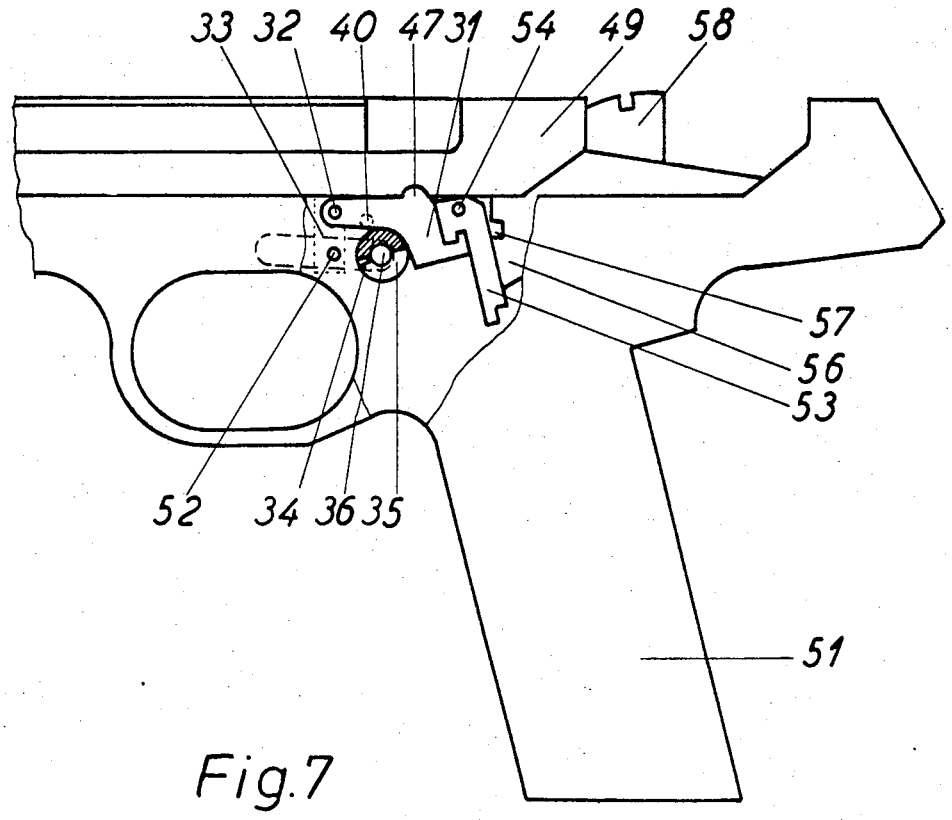
Figure 8:
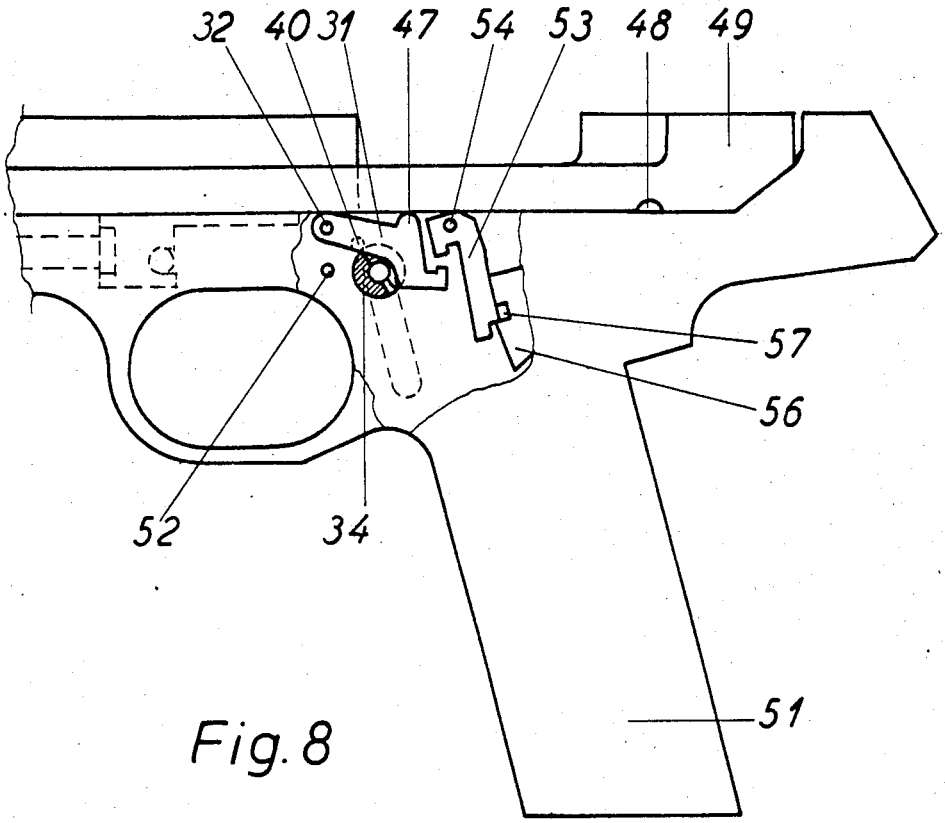
Figure 9:
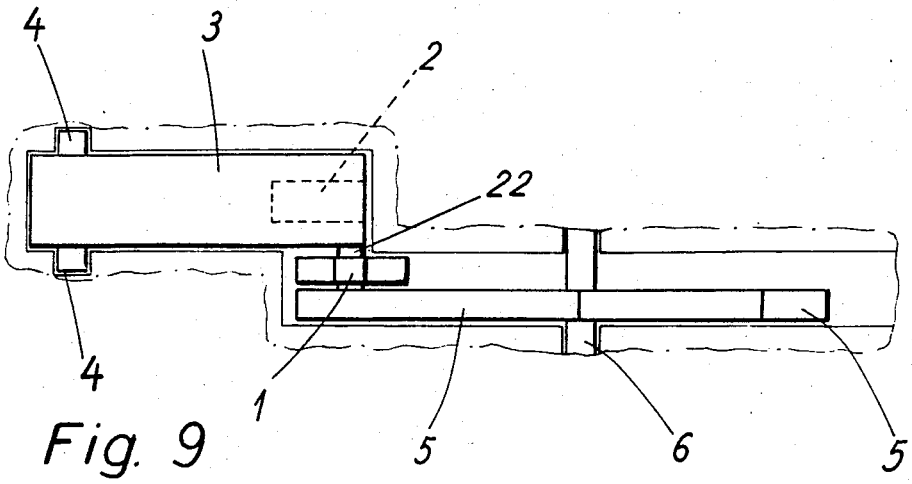
Figure 10:
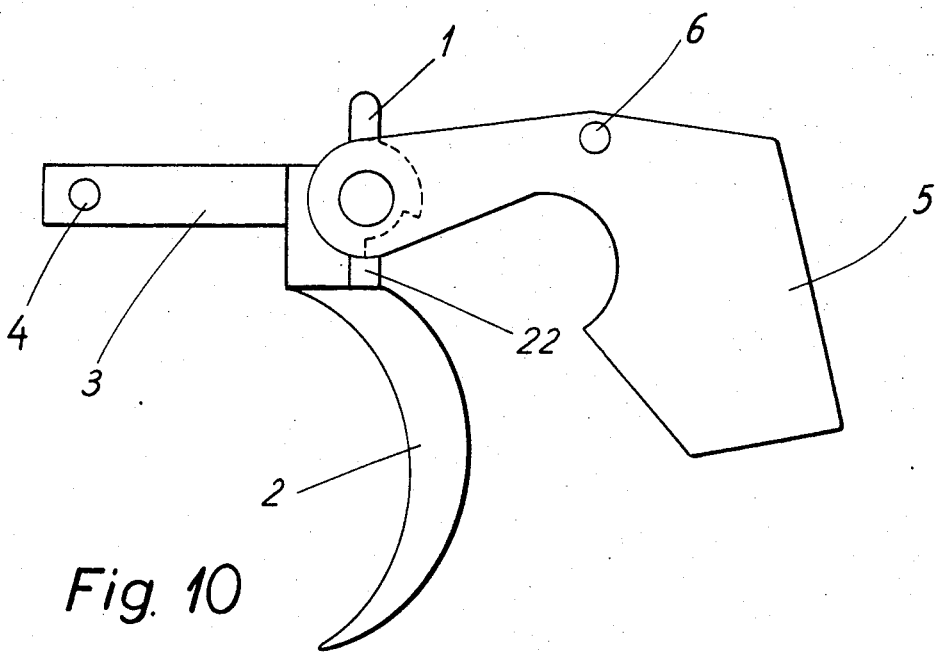

The present invention will now be described in more detail and with reference to the accompanying drawings, where FIG. 1 shows the trigger mechanism in the safety-off and cocked position, FIG. 2 shows the coupling, the disconnector, FIG. 3 shows the pistol in the safety-on and locked position, FIG. 4 shows the pistol with the slide in the rearmost position, FIG. 5 showing the present invention along here B—B of FIG. 6; all FIG. 6 shows the present invention along here A—A of FIG. 5.

As will be seen from FIGS. 1–4, which show one embodiment of the present invention, the trigger mechanism is built into the stationary part of the pistol. The trigger 2, see FIGS. 1 and 3, is provided with an overlying bush whch can be secured in a movable manner to a trigger arm 3, the front end of which is mounted on an axle 4. This unit is connected to the remaining part of the mechanism via a disconnector or coupling 1.

The disconnector is shown more clearly in FIG. 2, from which it can be seen that it can be turned approx. 45° clockwise against the action of a spring, to the turned position as shown in FIG. 4. In this position, the trigger is disengaged from the mechanism, and coupling does not take place until the slide 17 is moved forwards into the position shown in FIGS. 1 and 3, where the upwardly extending stud on the disconnector can stand in the vertical position, in that a recess 18 is provided in the bottom of the slide 17.

To the disconnector 1 is connected a gripper 5 which is pivotally mounted on an axle 6, said axle 6 lying a little higher than the fulcrum of the disconnector 1. Therefore, upon actuation of trigger 2, the gripper 5 will turn clockwise so that its back edge will swing in against the shown spring. By employing a rotatable lock having a blocking piece 7 which can abut against the front edge of the gripper 5, the trigger can be locked by turning the blocking piece 7 until it abuts the gripper in its direction of movement, see FIG. 3. When the blocking piece is turned away from this position, see FIGS. 1 and 4, the gripper can be turned and the trigger actuated.

Referring to the drawings, the trigger function is explained as follows:

When the trigger (2) is actuated, the trigger arm (3) is turned counterclockwise around an axle (4), and when the disconnector (1) is in its "upright" position as shown in FIGS. 1, 3 and 6, a projection (22) on the trigger arm (3) (this projection is shown in FIGS. 5 and 6 and also in FIGS. 1, 3, 4) lifts the disconnector (1).

The disconnector (1) is pivotally connected to the gripper (5) to that the gripper (5) is turned clockwise around a pivot mounting (6), when the projection (22) lifts the disconnector. This will release the lever and hammer as disclosed above.

When the disconnector is turned away from its "upright" position a shown in FIG. 4 and FIG. 5, actuation of the trigger will turn the trigger arm (3) around the axle (4), but the projection (22 in FIG. 5) will not reach the disconnector, thus the pistol can not be fired in this position.

The lower side and the rear edge of the gripper are shaped to form a projection which can engage with a projection 9 in the front edge of a lever 8. The lever 8 can thus be cocked by moving the slide 17 backwards, as shown in FIG. 4, and secured in this cocked position by means of the gripper 5.

The edges of both the gripper 5 and the lever 8 are curved, and their axles of rotation 6 and 10 lie substantially at the same level, the result being that the engagement becomes self-locking. This provides maximum security against premature release of the holding engagement between the gripper and the lever.

The other end of the lever is mounted on an axle 10 which has a portion milled away to form a notch for a pin or a projection 20 on a superjacent hammer retainer 13. This retainer 13 has a pivot mounting 14 at its top end, and therefore it turns against a spring in the lengthwise direction of the pistol.

Finally, the hammer 11 is pivotally mounted on an axle 19 and influenced to strike against the firing pin by means of a spring 16, said spring 16 being mounted around a rod 15. The curved rear edge of the hammer has a projection 12 which, when the hammer is in its cocked position, see FIGS. 1 and 4, can form a locking engagement with the projection 21 on the hammer retainer 13. The hammer pivot 19 and the retainer pivot 14 lie similarly along a line which is substantially a little above the point of engagement 21, 12, and since these parts are also curved, once again a self-locking engagement is achieved. There is thus the greatest possible security against premature release of the engagement, in that the parts wil be pressed together in the locking position.

This trigger mechanism with its exchange transmission ratio results in only the minimum amount of trigger movement being necessary in order for the mechanism to function. The trigger pull can be adjusted from 0.05 mm up to approx. 5.0 mm. The force necessary to actuate the trigger is only a few grams, but can be adjusted upwards to, for example, 2500 g. This is possible since the spring that presses the level 8 upwards can be weak, for example of about 100 g. Since the lever provides an exchange with the axle of about 1:60, the result is that the turning moment produced at the axle is approx. 6000 g, which is enough to disengage the hammer retainer 13 from the hammer 11. Furthermore, the low degree of spring power applied to the lever 8 also enables the gripper 5 to be loaded with a quite low pressure, thus resulting in such a smooth and precise actuation of the trigger mechanism. There is no resistance offered by the disconnector, the reason being that this can turn during the pulling movement.

By moving the slide 17 backwards slightly, the lever 8 can be cocked without the hammer 11 needing to be cocked, which means that the lever 8 also provides the possibility of dry-run shooting under training. Moreover, the lever can also be provided with an outwardly extending stud, so that the lever can be cocked by pressing the stud down with a finger. This means that the pistol can be used for training purposes with a trigger characteristic which is exactly the same as that when shooting.

I claim:

1. A trigger mechanism for a pistol with a trigger, which, when actuated, releases a spring-loaded hammer, characterized in that the mechanism comprises a lever actuated by the trigger, said trigger mechanism comprising a trigger secured to a trigger arm the front of which is mounted pivotally on an axle and a projection which can engage with a disconnector being pivotally mounted on the front end of a gripper, when a stud on the disconnector is extending upwardly in a vertical position, turning the gripper clockwise around a pivot mounting higher than the fulcrum of the disconnector, said lever being pivotally mounted on (the) an upper part and at the rear end of the pistol, and fixedly connected to a rotatable axle having a notch which can engage with a projection on a hammer retainer, said retainer being pivotally mounted at its upper end on an axle, and having a projection which oan engage with a recess in an outer side of the hammer.

2. A trigger mechanism according to claim 1, characterized in that the front end of the lever has a projection which can be engaged by (a) the gripper, (said gripper having a pivot mountable and being connected to the trigger) and where the forepart of said lever adjoins the plane of the underside of a locking slide.

3. A trigger mechanism according to claim 2, characterized in that (the gripper is connected to the trigger by a pivotable coupling) the disconnector with an upwardly extending stud releases the connection of the gripper to the trigger, (which) when the stud is turned away from the vertical position (, releases the connection).

4. A trigger mechanism according to claim 3, characterized in that when in its vertical position, the stud projects upwards into a recess in the slide, when said slide is in its forward position.

* * * * *

UNITED STATES PATENT AND TRADEMARK OFFICE

CERTIFICATE OF CORRECTION

PATENT NO. : 4,706,401

DATED : November 17, 1987

INVENTOR(S) : Bent A. Nielsen

It is certified that error appears in the above-identified patent and that said Letters Patent is hereby corrected as shown below:

On the title page, before item "[22]" insert -- filed May 21, 1986 -- and -- Danish applications 1077/81 and 1078/81, both filed March 10, 1981 --.

Signed and Sealed this

Nineteenth Day of April, 1988

*Attest:*

*Attesting Officer*

DONALD J. QUIGG

*Commissioner of Patents and Trademarks*